US009972247B2

(12) United States Patent
Lee et al.

(10) Patent No.: US 9,972,247 B2
(45) Date of Patent: May 15, 2018

(54) POWER SUPPLY DEVICE AND DISPLAY DEVICE INCLUDING THE SAME

(71) Applicant: Samsung Display Co., Ltd, Yongin, Gyeonggi-Do (KR)

(72) Inventors: Seung-Jun Lee, Seoul (KR); Jang-Hui Kim, Suwon-si (KR); Hwan-Woo Lee, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 440 days.

(21) Appl. No.: 14/697,139

(22) Filed: Apr. 27, 2015

(65) Prior Publication Data

US 2016/0148570 A1 May 26, 2016

(30) Foreign Application Priority Data

Nov. 21, 2014 (KR) ..... 10-2014-0163328

(51) Int. Cl.
*G09G 3/3258* (2016.01)
*G09G 3/3225* (2016.01)

(52) U.S. Cl.
CPC ..... *G09G 3/3258* (2013.01); *G09G 3/3225* (2013.01); *G09G 2300/0866* (2013.01);
(Continued)

(58) Field of Classification Search
CPC combination set(s) only.
See application file for complete search history.

(56) References Cited

U.S. PATENT DOCUMENTS 7,317,302 B1 1/2008 Collins
2006/0145961 A1 7/2006 Hu
(Continued)

FOREIGN PATENT DOCUMENTS

CN 103680422 A 3/2014
EP 2 639 784 A2 9/2013
(Continued)

OTHER PUBLICATIONS

Extended European Search Report dated Apr. 12, 2016 for European Patent Application No. EP 15 172 189.1, which corresponds to subject U.S. Appl. No. 14/697,139.
(Continued)

*Primary Examiner* — Van N Chow
(74) *Attorney, Agent, or Firm* — Knobbe Martens Olson & Bear LLP

(57) ABSTRACT

A power supply device and a display device including the same disclosed. In one aspect, the power supply device includes a DC-DC converter including a power supply having an input voltage and configured to generate a power voltage and a power current based at least in part on the input voltage and a feedback voltage and supply the power voltage to an output line. A detector is configured to detect the power voltage and the power current, a feedback circuit configured to generate the feedback voltage based at least in part on the power voltage and the power current and supply the feedback voltage to the DC-DC converter. A memory is configured to store a power error voltage signal corresponding to a power error voltage including the difference between the power voltage and a reference power voltage.

20 Claims, 5 Drawing Sheets

(52) U.S. Cl.
CPC ... *G09G 2310/08* (2013.01); *G09G 2320/045* (2013.01); *G09G 2330/028* (2013.01)

(56) References Cited

U.S. PATENT DOCUMENTS

2008/0309608 A1* 12/2008 Shen ..... G09G 3/3696 345/101
2011/0043505 A1* 2/2011 Ahn ..... H02M 3/07 345/211
2011/0316838 A1 12/2011 Ahn
2012/0161637 A1* 6/2012 Lee ..... G09G 3/32 315/122
2013/0016086 A1 1/2013 Ebisuno et al.
2013/0241808 A1* 9/2013 Kwon ..... H02M 3/158 345/76
2014/0085284 A1 3/2014 Sun et al.
2014/0139132 A1* 5/2014 Kwak ..... G09G 3/006 315/224
2014/0204074 A1 7/2014 Kimura
2015/0161950 A1 6/2015 Yang

FOREIGN PATENT DOCUMENTS

KR 10-2011-0012274 A 2/2011
KR 10-2013-0101303 A 9/2013
KR 10-2014-0051745 A 5/2014

OTHER PUBLICATIONS

Office Action dated Mar. 29, 2018 in corresponding European Application No. 15 172 189.1-1209.

* cited by examiner

POWER SUPPLY DEVICE AND DISPLAY DEVICE INCLUDING THE SAME

CROSS-REFERENCE TO RELATED APPLICATION(S)

This application claims priority under 35 USC § 119 to Korean Patent Application No. 10-2014-0163328, filed on Nov. 21, 2014 in the Korean Intellectual Property Office (KIPO), the contents of which are incorporated herein in its entirety by reference.

BACKGROUND

Field

The described technology generally relates to a power supply device and a display device including the power supply device.

Description of the Related Technology

Flat panel displays (FPDs) are widely used as a display for electronic devices because FPDs are relatively lightweight and thin compared to cathode-ray tube (CRT) displays. Examples of FPD technologies include liquid crystal displays (LCDs), field emission displays (FEDs), plasma display panel (PDP) devices, and organic light-emitting (OLED) displays. OLED displays are considered to be next-generation displays because they have favorable characteristics such as wide viewing angles, rapid response speeds, thin profiles, low power consumption, etc.

SUMMARY OF CERTAIN INVENTIVE ASPECTS

One inventive aspect is a power supply device that can compensate for degradation of pixels included a display panel.

Another aspect is a display device that includes the power supply device.

Another aspect is a power supply device that includes a DC-DC converter configured to generate a power voltage based on an input voltage and a feedback voltage and to provide the power voltage to an output line, a detecting unit configured to detect the power voltage provided to the output line and a power current that flows through the output line, a feedback unit configured to generate the feedback voltage based on the power voltage and the power current and to provide the feedback voltage to the DC-DC converter, and an error storing unit configured to store a power voltage error that is a difference between the power voltage provided to the output line and a reference power voltage and a power current error that is a difference between the power current flowing through the output line and a reference power current.

In example embodiments, the power supply is coupled to an external system, and the external system receives the power voltage and the power current that are detected in the detecting unit, calculate the power voltage error and the power current error based on the power voltage and the power current that are provided from the detecting unit, and write the power voltage error and the power current error into the error storing unit.

In example embodiments, the detecting unit includes a detection resistor formed in the output line of the DC-DC converter and an analog-digital converter configured to convert the power voltage provided to the output line into a first digital signal, and to convert a voltage between ends of the detection resistor into a second digital signal.

In example embodiments, the analog-digital converter converts the reference power voltage that is provided from a load device positioned at the outside of the power supply device to a third digital signal, convert the reference power current that is provided from the load device positioned at the outside of the power supply device to a fourth digital signal, and provide the third digital signal and the fourth digital signal to the external system.

In example embodiments, the external system calculates the power voltage error by subtracting the first digital signal corresponding to the power voltage provided to the output line from the third digital signal corresponding to the reference power voltage, and write the power voltage error into the error storing unit.

In example embodiments, the external system calculates the power current error by subtracting the second digital signal corresponding to the power current flowing through the output line from the fourth digital signal corresponding to the reference power current, and write the power current error into the error storing unit.

In example embodiments, the power supply device further includes a switch unit configured to receive the reference power current from a load device positioned at the outside of the power supply device, and the analog-digital converter converts the reference power current provided through the switch unit into a fourth digital signal and provide the fourth digital signal to the external system.

In example embodiments, the switch unit selectively provides the reference power current of a normal mode or the reference power current of the low current mode to the analog-digital converter.

In example embodiments, the power supply device is coupled to an external system, and the external system generates a feedback control signal based on a first digital signal corresponding to the power voltage provided to the output line and a second digital signal corresponding to the power current flowing through the output line and provide the feedback control signal to the feedback unit.

In some example embodiments, the feedback unit includes a digital-analog converter configured to convert the feedback control signal provided from the external system to a feedback analog signal, and a feedback voltage generating unit configured to generate the feedback voltage that controls the power voltage based on the feedback analog signal.

In some example embodiments, the feedback voltage generating unit includes a plurality of resistors, and the feedback voltage generating unit selects one of divided voltages generated based on the plurality of resistors and output the divided voltage as the feedback voltage.

Another aspect is a display device that includes a display panel including a plurality of pixels, a data driver configured to provide a data signal to the plurality of pixels, a scan driver configured to provide a scan signal to the plurality of pixels, a power supplier configured to generate a power voltage based on an input voltage and a feedback voltage, and to provide the power voltage to the plurality of pixels through an output line, and a timing controller configured to control the data driver, the scan driver, and the power supplier, and the power supplier can store a power voltage error that is a difference between the power voltage provided to the output line and a reference power voltage and a power current error that is a difference between a power current flowing through the output line and a reference power current.

In example embodiments, the power supplier includes a DC-DC converter configured to generate the power voltage based on the input voltage and the feedback voltage and to provide the power voltage to the output line, a detecting unit configured to detect a pixel power voltage provided to the pixels and a pixel power current flowing through the pixels through a detecting line, a feedback unit configured to generate the feedback voltage based on the pixel power voltage and the pixel power current, and to provide the feedback voltage to the DC-DC converter, and an error storing unit configured to store the power voltage error that is the difference between the power voltage and the reference voltage and the power current error that is the difference between the power voltage flowing through the output line and the reference power current.

In example embodiments, the detecting unit includes a detection resistor formed in the detecting line, and an analog-digital converter converts the pixel power voltage detected through the detecting line to a first digital signal, and converts a voltage between ends of the detection resistor to a second digital signal.

In example embodiments, the timing controller generates a feedback control signal that controls the feedback unit based on the first digital signal, the second digital signal, the power voltage error, and the power current error.

In example embodiments, the feedback unit includes a digital-analog converter configured to convert the feedback control signal provided from the timing controller to a feedback analog signal and a feedback voltage generating unit configured to generate the feedback voltage that controls the power voltage based on the feedback analog signal.

In example embodiments, the feedback voltage generating unit includes a plurality of resistors, and the feedback voltage generating unit selects one of divided voltages generated based on the plurality of resistors and outputs the divided voltage as the feedback voltage.

In example embodiments, the power supplier is coupled to the timing controller.

In example embodiments, the power supplier is included in the timing controller.

Another aspect is a power supply device for a display device, comprising a direct current to direct current (DC-DC) converter including a power supply having an input voltage and configured to i) generate a power voltage and a power current based at least in part on the input voltage and a feedback voltage and ii) supply the power voltage to an output line. The power supply device also comprises a detector configured to detect the power voltage and the power current, a feedback circuit configured to i) generate the feedback voltage based at least in part on the power voltage and the power current and ii) supply the feedback voltage to the DC-DC converter, and a memory configured to store i) a power error voltage signal corresponding to a power error voltage including the difference between the power voltage and a reference power voltage and ii) a power error current signal corresponding to a power error current including the difference between the power current and a reference power current.

In the above power supply device, the power supply is electrically connected to an external system, wherein the external system is configured to i) receive the power voltage and the power current from the power supply, ii) calculate the power error voltage and the power error current based at least in part on the power voltage and the power current, and iii) write the power error voltage signal and the power error current signal into the memory.

In the above power supply device, the detector includes a detection resistor formed in the output line and an analog-digital converter configured to convert i) the power voltage into a first digital signal and ii) a voltage between opposing ends of the detection resistor into a second digital signal.

In the above power supply device, the analog-digital converter is further configured to i) convert the reference power voltage, provided from a load device located outside the power supply device, to a third digital signal, ii) convert the reference power current, provided from the load device, to a fourth digital signal, and iii) transmit the third and fourth digital signals to the external system.

In the above power supply device, the external system is further configured to i) calculate the power error voltage corresponding to the difference between the first and third digital signals and ii) write the power error voltage signal into the memory.

In the above power supply device, the external system is further configured to i) calculate the power error current corresponding to the difference between the second and fourth digital signals and ii) write the power error current signal into the memory.

The above power supply device further comprises a switch configured to receive the reference power current from a load device located external to the power supply device, wherein the analog-digital converter is further configured to i) convert the reference power current into a fourth digital signal and ii) transmit the fourth digital signal to the external system.

In the above power supply device, the switch is further configured to selectively supply the reference power current corresponding to a normal mode or a low current mode to the analog-digital converter.

In the above power supply device, the power supply is electrically connected to an external system, wherein the external system is further configured to i) generate a feedback control signal based at least in part on a first digital signal corresponding to the power voltage and a second digital signal corresponding to the power current, and ii) transmit the feedback control signal to the feedback unit.

In the above power supply device, the feedback circuit includes a digital-analog converter configured to convert the feedback control signal to a feedback analog signal and a feedback voltage generator configured to generate the feedback voltage based at least in part on the feedback analog signal, wherein the DC-DC converter is further configured to control the power voltage based at least in part on the feedback voltage.

In the above power supply device, the feedback voltage generator includes a plurality of resistors configured to voltage-divide the feedback analog signal into a plurality of voltages, wherein the feedback voltage generator is further configured to select one of the divided voltages and output the selected divided voltage as the feedback voltage.

Another aspect is a display device comprising a display panel including a plurality of pixels, a data driver configured to supply a data signal to the pixels, a scan driver configured to supply a scan signal to the pixels, and a power supplier configured to i) generate a power voltage based at least in part on an input voltage and a feedback voltage and provide the power voltage to the pixels through an output line, wherein the output line is configured to transfer a power current. The display also comprises a timing controller configured to control the data driver, the scan driver, and the power supplier, wherein the power supplier is further configured to store i) a power error voltage signal corresponding to a power error voltage including the difference between the power voltage and a reference power voltage, and ii) a power error current signal corresponding to a power error current including the difference between the power current and a reference power current.

In the above display device, the display panel is configured to transmit a pixel power voltage and a pixel power current to the pixels, wherein the power supplier includes a direct current to direct current (DC-DC) converter configured to i) generate the power voltage based at least in part on the input voltage and the feedback voltage and ii) transmit the power voltage to the output line. In the above display device, the power supplier also includes a detector configured to detect the pixel power voltage and the pixel power current through a detecting line, a feedback circuit configured to i) generate the feedback voltage based at least in part on the pixel power voltage and the pixel power current and ii) transmit the feedback voltage to the DC-DC converter, and an memory configured to store the power error voltage signal and the power error current signal.

In the above display device, the timing controller is further configured to receive the power error voltage signal and the power error current signal when the display panel is turned on.

In the above display device, the detector includes a detection resistor formed in the detecting line and an analog-digital converter configured to convert the pixel power voltage to a first digital signal and convert a voltage between opposing ends of the detection resistor to a second digital signal.

In the above display device, the timing controller is further configured to generate a feedback control signal based at least in part on the first and second digital signals, the power error voltage signal, and the power error current signal, wherein the feedback control is configured to control the feedback circuit.

In the above display device, the feedback circuit includes a digital-analog converter configured to convert the feedback control signal to a feedback analog signal and a feedback voltage generator configured to generate the feedback voltage based at least in part on the feedback analog signal, wherein the DC-DC converter is further configured to control the power voltage based at least in part on the feedback voltage.

In the above display device, the feedback voltage generator includes a plurality of resistors configured to voltage-divide the feedback analog signal into a plurality of voltages, wherein the feedback voltage generator is further configured to select one of the divided voltages and output the selected divided voltage as the feedback voltage.

In the above display device, the power supplier is electrically connected to the timing controller.

In the above display device, the timing controller includes the power supplier.

According to at least one of the disclosed embodiments, a power supply device stores an error of a power voltage of the power supply device and an error of a power current of the power supply device, and generates a power voltage that accurately compensates a degradation of pixels included in the display panel by applying the error of the power voltage and the error of the power current. Thus, an image quality of the display panel having the power supply device can be improved.

DETAILED DESCRIPTION OF CERTAIN INVENTIVE EMBODIMENTS

A power supply device that provides power via a voltage, also known as power voltage, to a display device can detect the voltage provided to pixels and the current flowing through the pixels. It can generate the proper voltage that compensates for degradation of the pixels based on the detected voltage and current. However, pixel degradation is not properly measured if the power supply device is not operating within a range of tolerance.

Hereinafter, the described technology will be explained in detail with reference to the accompanying drawings. While the inventive technology has been described with reference to the figures, it will be understood by those of ordinary skill in the art that various changes in form and details can be made therein without departing from the spirit and scope as defined by the following claims.

Figure 1:
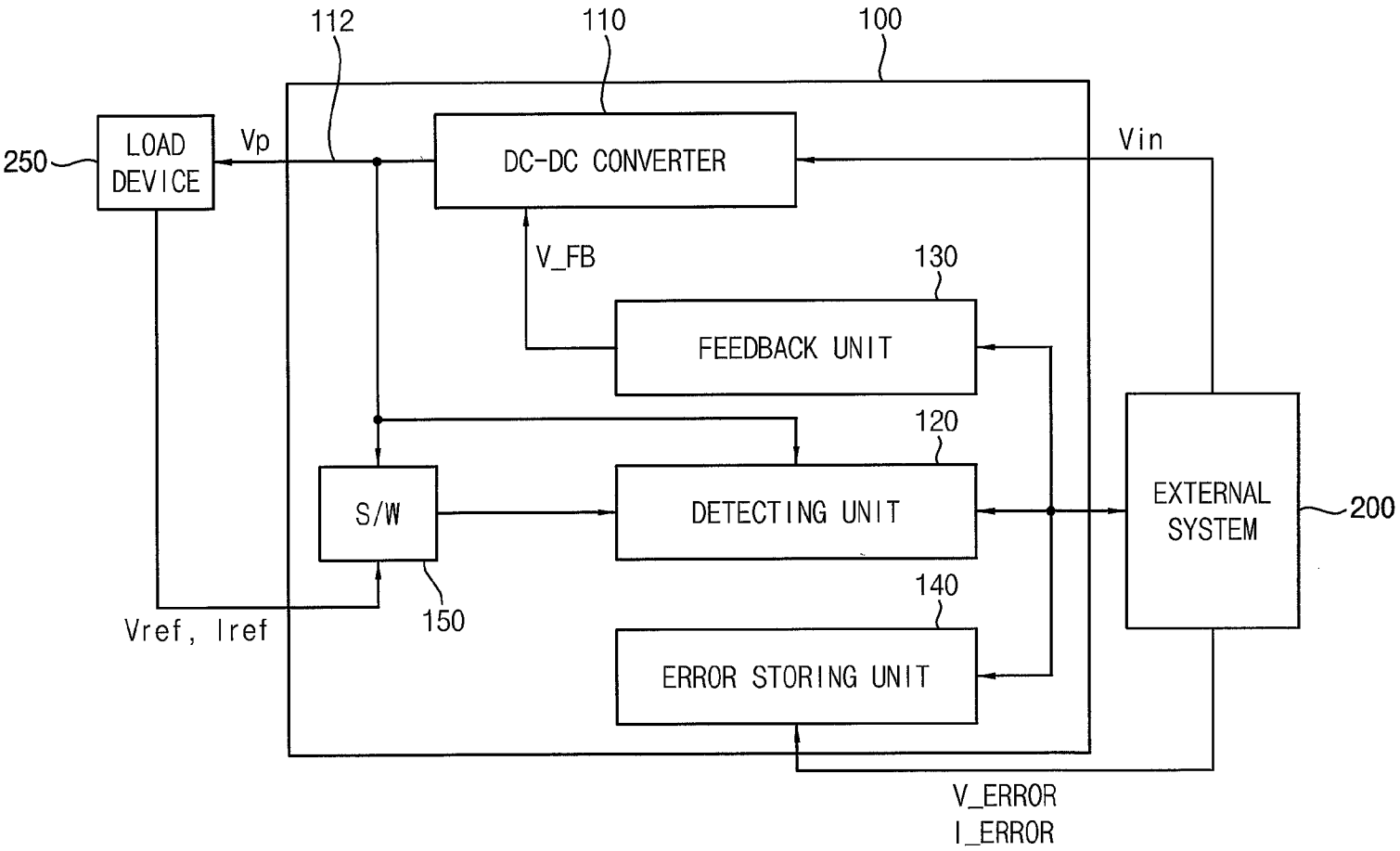
FIG. 1 is a block diagram illustrating a power supply device according to example embodiments.
Figure 2:
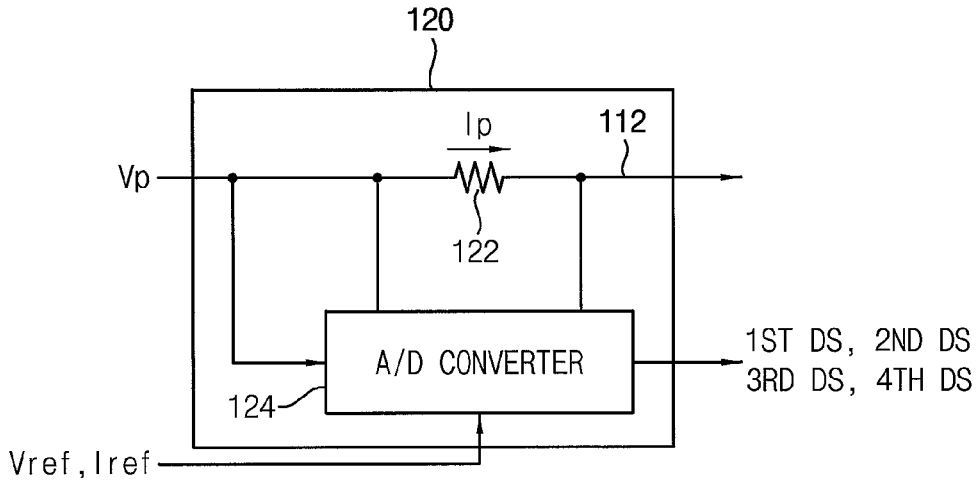
FIG. 2 is a diagram illustrating a detecting unit included in the power supply device of FIG. 1.
Figure 3:
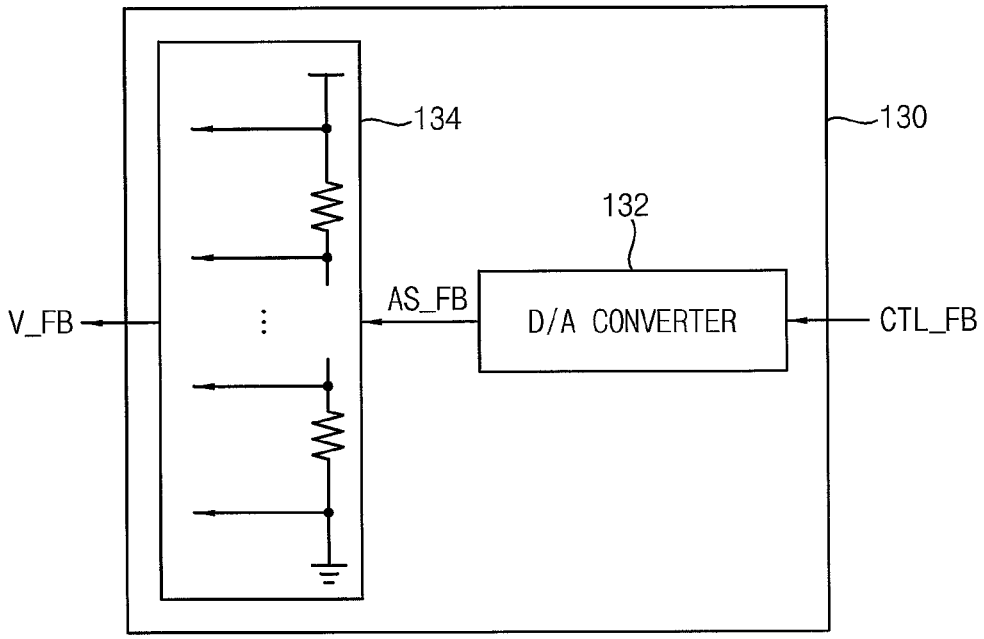
FIG. 3 is a circuit diagram illustrating a feedback unit included in the power supply device of FIG. 1.

Referring to FIGS. 1 through 3, a power supply device 100 includes a DC-DC converter 110, a detecting unit or detector 120, a feedback unit or feedback circuit 130, and an error storing unit or memory 140.

The power supply device 100 can provide a power voltage to a display panel. For example, the power voltage is a high power voltage (ELVDD) or a low power voltage (ELVSS). The power supply device 100 can calculate a degree of degradation of pixels by detecting a power voltage provided to the pixels and a power current flowing through the pixels. The power supply device 100 can generate a feedback voltage based on the degree of the degradation of the pixels. The power supply device 100 can generate a power voltage that compensates the degradation of the pixels based on the feedback voltage. However, the feedback voltage is not accurately generated if an error occurs in internal elements included in the power supply device 100. To overcome this problem, the power supply device 100 can include an error storing unit 140 and can store a power voltage error, or power error voltage, and a power current error, or a power error current, that occurs in the internal elements The error storing unit 140 can store a power error voltage signal corresponding to the power error voltage and a power error current corresponding to the power error current. Hereinafter, the terms "power error voltage signal" and "power error voltage" will be used interchangeably. Further, the terms "power error current signal" and "power error current" will also be used interchangeably. Here, the power voltage error and the power current error can be stored in the error storing unit 140 during a manufacturing process of the power supply device 100. Thus, a display device that includes the power supply device 100 can accurately generate the power voltage that compensates the degradation of the pixels by detecting the power voltage provided to the pixels and the power current flowing through the pixels, and applying the power voltage error and the power current error that occurs in the internal elements included in the power supply device 100.

Hereinafter, the power supply device 100 of FIG. 1 in which the power voltage error and the power current error is stored during the manufacturing process will be described.

The power supply device 100 can be coupled to an external system 200 and a load device 250 in the manufacturing process of the power supply device 100. The external system 200 and the power supply device 100 can provide and receive signals using an I2C (Inter Integrated Circuit) communication protocol. The external system 200 can receive signals from the power supply device 100 and can provide control signals that control the power supply device 100. For example, the external system 200 is a computer device that includes software having a calculation function, a control function, etc. The load device 250 can receive the power voltage from the power supply device 100 and can operate as a load corresponding to the display panel.

The DC-DC converter 110 can provide the power voltage Vp to an output line 112 by generating the power voltage Vp based on an input voltage Vin and a feedback voltage V_FB. The DC-DC converter 110 can receive the input voltage Vin from the external system 200 or a voltage source positioned at the outside of the power supply device 100. The DC-DC converter 110 can generate the power voltage Vp by increasing or decreasing the input voltage Vin. Here, a voltage level of the power voltage Vp can be determined by the feedback voltage V_FB provided from the feedback unit 130. In some embodiments, the DC-DC converter 110 is implemented as a buck converter. In this case, the DC-DC converter 110 can generate the power voltage Vp by decreasing the input voltage Vin. In other embodiments, the DC-DC converter 110 is implemented as a boost converter. In this case, the DC-DC converter 110 can generate the power voltage Vp by increasing the input voltage Vin. The DC-DC converter 110 can generate a red color power voltage provided to red color pixels of the display panel, a green color power voltage provided to green color pixels of the display panel, and a blue color power voltage provided to blue color pixels of the display panel.

The detecting unit 120 can detect the power voltage Vp provided to the output line 112 and a power current Ip flowing through the output line 112. Referring to FIG. 2, the detecting unit 120 includes a detection resistor 122 and an analog-digital converter (analog to digital converter; ADC) 124. The detection resistor 122 can be formed in the output line 112 of the DC-DC converter 110. The detecting unit 120 can detect the power current Ip flowing through the output line 112 using a voltage between ends of the detection resistor 122. The detection unit 120 can further include an amplifier (not shown). The amplifier can amplify the voltage between ends of the detection resistor 122 and can provide the amplified voltage to the analog-digital converter 124. The analog-digital converter 124 can convert the power voltage Vp provided to the output line 112 to a first digital signal 1ST DS and can convert the voltage between the ends of the detection resistor 122 to a second digital signal 2ND DS. The first digital signal 1ST DS and the second digital signal 2ND DS can be provided to the external system 200. Further, the analog-digital converter 124 can receive a reference power voltage Vref and a reference power current Iref from the load device 250 coupled to the power supply device 100. The analog-digital converter 124 can convert the reference power voltage Vref to a third digital signal 3RD DS, and convert the reference power current Iref to a fourth digital signal 4TH DS. The third digital signal 3RD DS and the fourth digital signal 4TH DS can be provided to the external system 200.

The load device 250 can receive the power voltage Vp through the output line 112 and can operate as the load corresponding to the display panel. The detecting unit 120 can receive the reference power voltage Vref from the load device 250. In some embodiments, the detecting unit 120 receives the reference power current Iref of a normal mode from the load device 250. In other embodiments, the detecting unit 120 receives the reference power current Iref of a low current mode from the load device 250. Here, the power supply device 200 can further include a switch unit or switch 150 that receives the reference power current Iref from the load device 250. The switch unit 150 can selectively provide the reference power current Iref of the normal mode or the reference power current Iref of the low current mode to the analog-digital converter 124 of the detecting unit 120.

The external system 200 can receive the power voltage Vp and the power current Ip that are detected in the detecting unit 120. The external system 200 can calculate a power voltage error V_ERROR and a power current error I_ERROR based on the power voltage Vp and a power current Ip. The external system 200 can write the power voltage error V_ERROR and the power current error I_ERROR into the error storing unit 140. For example, the external system 200 receives the first digital signal 1ST DS corresponding to the power voltage Vp and the second digital signal corresponding to the power current Ip from the analog-digital converter 124. Further, the external system 200 can receive the third digital signal 3RD DS and the fourth digital signal 4TH DS from the analog-digital converter 124. The external system 200 can calculate the power voltage error V_ERROR by subtracting the first digital signal 1ST DS corresponding to the power voltage provided to the output line 112 from the third digital signal 3RD DS corresponding to the reference power voltage Vref. Further, the external system 200 can calculate the power current error I_ERROR by subtracting the second digital signal 2ND DS corresponding to the power current flowing through the output line 112 from the fourth digital signal 4TH DS corresponding to the reference power current Iref. In some embodiments, the fourth digital signal 4TH DS is a digital signal corresponding to the reference power current Iref of the normal mode. In other embodiments, the fourth digital signal 4TH DS is a digital signal corresponding to the reference power current Iref of the low current mode. The external system 200 can write the power voltage error V_ERROR and the power current error I_ERROR into the error storing unit 140. Here, the error storing unit 140 can be a storage device that stores the power voltage error V_ERROR and the power current error I_ERROR. For example, the error storing unit 140 is implemented as EPROM (Erasable Programmable Read-Only Memory), EEPROM (Electrically Erasable Programmable Read-Only Memory), PRAM (Phase Change Random Access Memory), flash memory, etc.

The feedback unit 130 can generate the feedback voltage V_FB based on the power voltage Vp and the power current Ip and can provide the feedback voltage V_FB to the DC-DC converter 110. Referring to FIG. 3, the feedback unit 130 includes a digital-analog converter (digital to analog converter; DAC) 132 and a feedback voltage generating unit or feedback voltage generator 134. The digital-analog converter 132 can convert a feedback control signal CTL_FB provided from the external system 200 to a feedback analog signal AS_FB. The external system 200 can provide the feedback control signal CTL_FB that is used to generate the feedback voltage V_FB to control a voltage level of the power voltage Vp generated from the DC-DC converter 110. The external system 200 can provide the feedback control signal CTL_FB that controls the feedback voltage V_FB to generate the predetermined power voltage Vp while the external system 200 calculates the power voltage error V_ERROR and the power current error I_ERROR and writes the power voltage error V_ERROR and the power current error I_ERROR into the error storing unit 140. The feedback voltage generating unit 134 can generate the feedback voltage V_FB that controls the power voltage Vp based on the feedback analog signal AS_FB. The feedback voltage generating unit 134 can include a plurality of resistors and output one of divided voltages that are generated by the resistors based on the feedback analog signal AS_FB.

Thus, a display device that includes the power supply device 100 can generate a compensated power voltage Vp for the power voltage error V_ERROR and the power current error I_ERROR.

Figure 4:
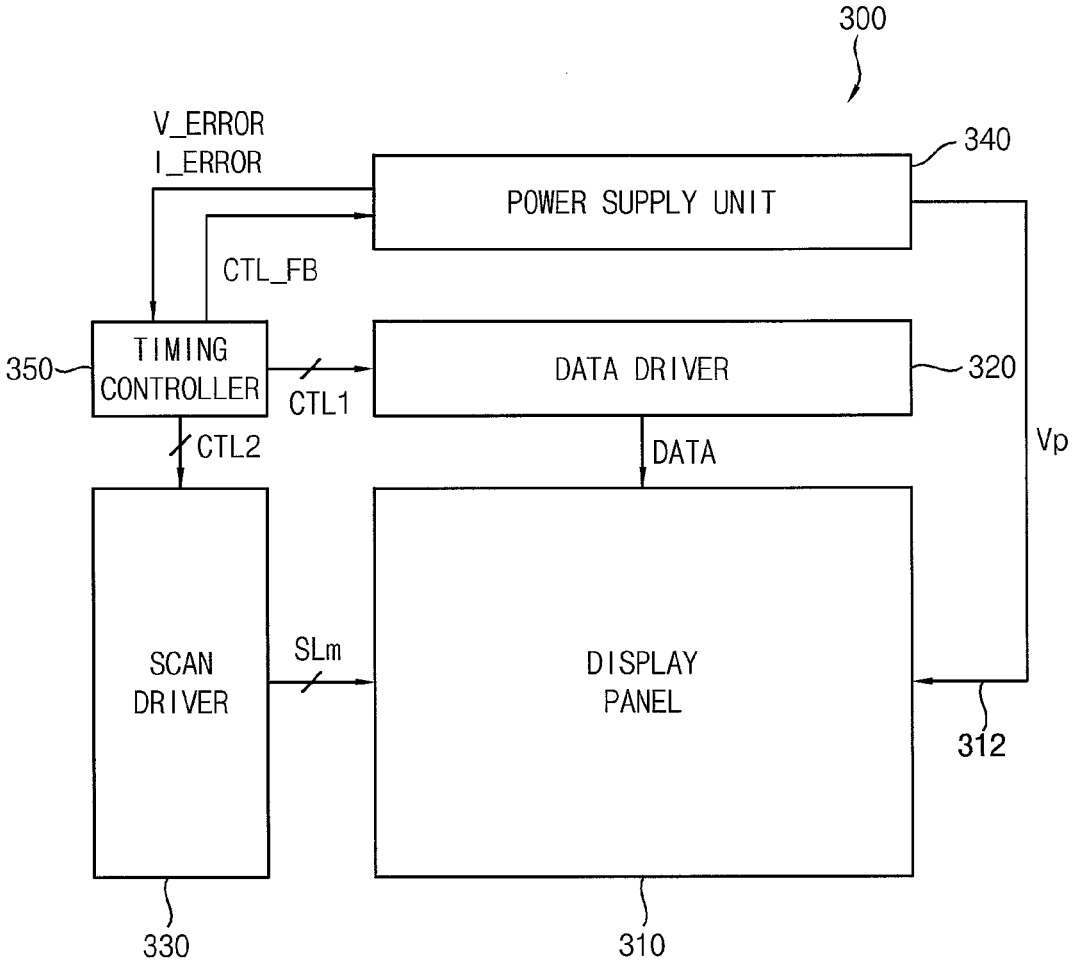
FIG. 4 is a block diagram illustrating a display device according to example embodiments.
Figure 5:
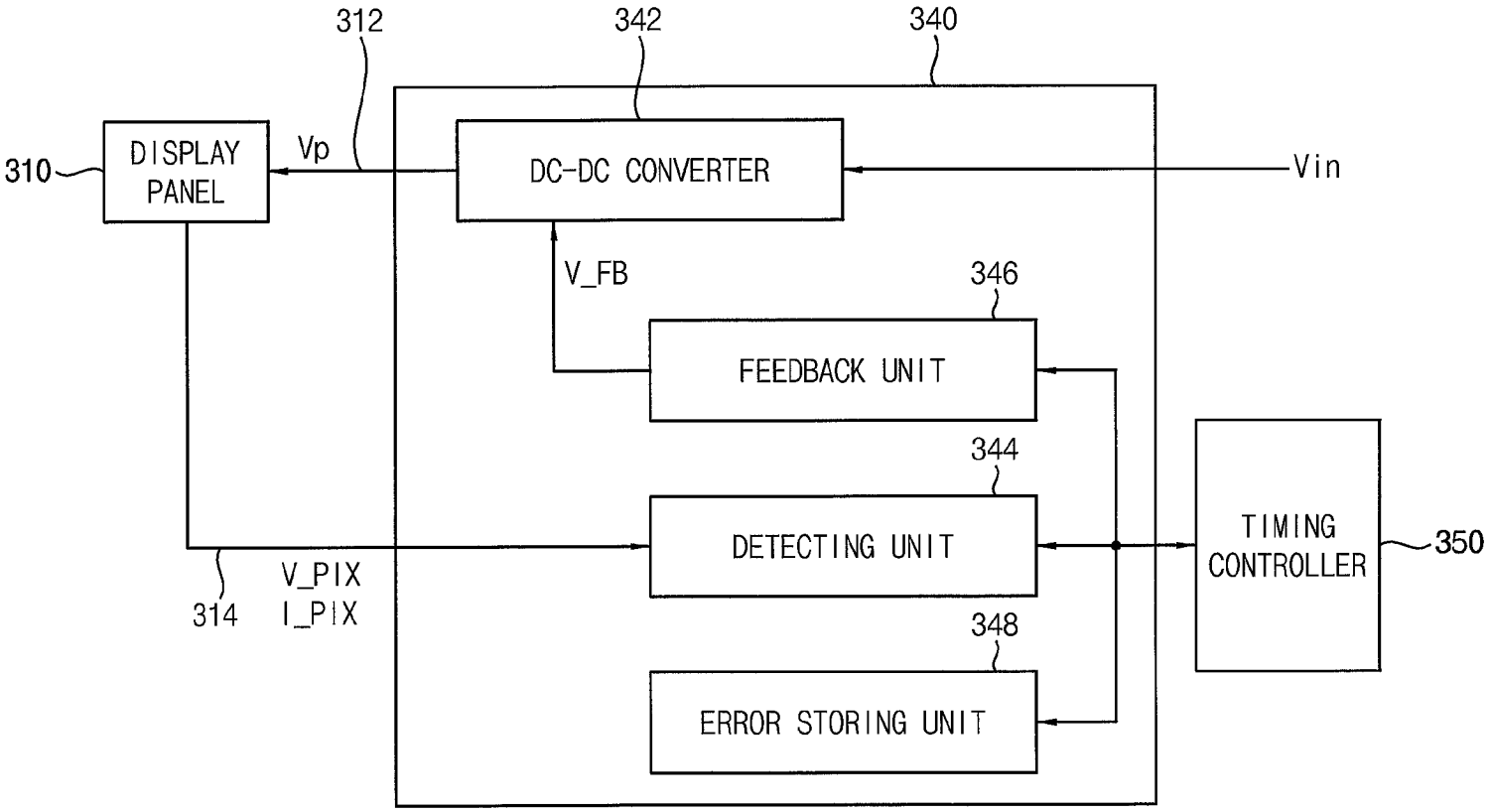
FIG. 5 is a block diagram illustration a power supplier included in the display device of FIG. 4.

FIG. 4 is a block diagram illustrating a display device according to example embodiments. FIG. 5 is a block diagram illustration a power supplier included in the display device of FIG. 4.

Referring to FIG. 4, the display device 300 includes a display panel 310, a data driver 320, a scan driver 330, a power supplier 340, and a timing controller 350.

The display panel 310 can include a plurality of pixels. In some embodiments, each of the pixels includes a pixel circuit, a driving transistor, and an OLED. In this case, the pixel circuit can control a current flowing through the OLED based on a data signal, where the data signal is provided via the data line DLm in response to the scan signal, where the scan signal is provided via the scan line SLn. The pixels can be driven based on a power voltage Vp provided from the power supplier 340.

The scan driver 330 can provide the scan signal to the pixels via the scan lines SLn. The data driver 320 can provide the data signal to the pixels via the data lines DLm according to the scan signal.

The power supplier 340 can generate the power voltage Vp based on an input voltage Vin and a feedback voltage V_FB and provide the power voltage Vp to the pixels through an output line 312. For example, the power voltage Vp is a high power voltage ELVDD or a low power voltage ELVSS to operate the pixels that are included in the display panel 310. Referring to FIG. 5, the power supplier 340 can include a DC-DC converter 342, a detecting unit or a detector 344, a feedback unit 346, and an error storing unit 348.

The DC-DC converter 342 can provide the power voltage Vp to the output line 312 by generating the power voltage Vp based on the input voltage Vin and the feedback voltage V_FB. The DC-DC converter 342 can receive the input voltage Vin from a voltage source such as a battery. The DC-DC converter 342 can generate the power voltage Vp by increasing or decreasing the input voltage Vin. Here, a voltage level of the power voltage Vp can be determined by the feedback voltage V_FB provided from the feedback unit 346. In some embodiments, the DC-DC converter 342 is implemented as a buck converter. In this case, the DC-DC converter 342 can generate the power voltage Vp by decreasing the input voltage Vin. In other embodiments, the DC-DC converter 342 can be implemented as a boost converter. In this case, the DC-DC converter 342 can generate the power voltage Vp by increasing the input voltage Vin. The DC-DC converter 342 can generate a red color power voltage provided to red color pixels of the display panel, a green color power voltage provided to green color pixels of the display panel, and a blue color power voltage provided to blue color pixels of the display panel.

The feedback unit 346 can generate the feedback voltage V_FB based on a feedback control signal CTL_FB and can provide the feedback voltage V_FB to the DC-DC converter 342. The feedback unit 346 can include a digital-analog converter and a feedback voltage generating unit. The digital-analog converter can convert the feedback control signal provided from the timing controller 350 to a feedback analog signal. The feedback voltage generating unit can generate the feedback voltage V_FB that controls the power voltage Vp output from the DC-DC converter based on the feedback analog signal. The feedback voltage generating unit can include a plurality of resistors, and can output one of divided voltages generated by the resistors as the feedback voltage V_FB based on the feedback analog signal. Here, the power voltage Vp can have a voltage level that compensates degradation of the pixels included in the display panel 310 based on the feedback voltage V_FB.

The detecting unit 344 can detect a pixel power voltage V_PIX that is provided to the pixels and a pixel power current I_PIX flowing through the pixels through a detecting line 314. The OLED included in the pixel can degrade as driving time increases. Thus, luminance of the OLED will naturally decrease with usage. The detecting unit 344 can sense a degree of the degradation of pixels by detecting the pixel power voltage V_PIX and the pixel power current I_PIX. Here, the detecting unit 344 can detect the pixel power voltage V_PIX provided to all of the pixels and the pixel power current I_PIX flowing through all of the pixels. Further, the detecting unit 344 can detect the pixel power voltage V_PIX provided to the partial pixels and the pixel power current I_PIX flowing through the partial pixels. The detecting unit 344 can include a detection resistor and an analog-digital converter. The detecting unit 344 can detect the pixel power voltage V_PIX through the detecting line 314 that couples the display panel 310 to the detecting unit 344. Further, the detecting unit 344 can include a detection resistor connected to the detecting line 314 and can detect the pixel power current I_PIX by detecting the voltage between ends of the detection resistor. The detecting unit 344 can further include an amplifier. The amplifier can amplify the voltage between ends of the detection resistor. The analog-digital converter can convert the pixel power voltage V_PIX to a first digital signal, can convert the voltage between the ends of the detection resistor to a second digital signal. The first and second digital signals can be provided to the timing controller 350.

The error storing unit 348 can store the power voltage error V_ERROR that is the difference between the power voltage Vp provided to the output line 312 and a reference power voltage. The error storing unit 348 can also store the power current error I_ERROR that is the difference between the power current flowing through the output line 312 and the reference power current. The power voltage error V_ERROR and the power current error I_ERROR can be stored in the error storing unit 348 during a manufacturing process of the power supplier 340. Specifically, the power supplier 340 can be coupled to an external system and a load device in a manufacturing process or the power supplier 340. The external system can provide signals that control the power supplier 340, and can write the power voltage error V_ERROR and the power current error I_ERROR into the error storing unit 348. The load device can operate as a load corresponding to the display panel 310. The power supplier 340 can provide the power voltage Vp to the load device through the output line 312. The detecting unit 344 can detect the power voltage Vp provided to the output line 312 and the power current flowing through the output line 312. Further, the detecting unit 344 can receive a reference power voltage and a reference power current from the load device. The detecting unit 344 can convert the power voltage Vp provided to the output line 312, the power current flowing through the output line 312, the reference power voltage, and the reference power current to digital signals and provide the digital signals to the external system. The external system can calculate the power voltage error V_ERROR by subtracting the digital signal corresponding to the power voltage Vp provided to the output line 312 from the digital signal corresponding to the reference power voltage. Further, the external system can calculate the power current error I_ERROR by subtracting the digital signal corresponding to the power current flowing through the output line 312 from the digital signal corresponding to the reference power current. The external system can write the power voltage error V_ERROR and the power current error I_ERROR into the error storing unit 348. The error storing unit 348 can store the power voltage error V_ERROR and the power current error I_ERROR. Here, the error storing unit 348 can store the power current error I_ERROR of a normal mode and the power current error I_ERROR of a low current mode. That is, the error storing unit 348 can store the power voltage error V_ERROR, the power current error I_ERROR of the normal mode, and the power current error I_ERROR of the low current mode. For example, the error storing unit 348 is implemented as EPROM, EEPROM, flash memory, etc.

The timing controller 350 can read the power voltage error V_ERROR and the power current error I_ERROR stored in the error storing unit 348 when the display panel 310 turns on. The timing controller 350 can calculate the degree of the degradation of the pixels based on the first digital signal corresponding to the pixel power voltage V_PIX provided to the pixels and the second digital signal corresponding to the pixel power current I_PIX flowing through the pixels and can generate the feedback control signal CTL_FB that controls the feedback voltage V_FB that compensates the degradation of the pixels. Here, the timing controller 350 can compensate the error of the power supplier 340 by generating the feedback control signal CTL_FB based on the power voltage error V_ERROR and the power current error I_ERROR. Further, the timing controller 350 can provide control signals that control the data driver 320 and the scan driver 330.

As described above, the display device 300 according to example embodiments can generate the power voltage Vp of which the power voltage error V_ERROR and the power current error I_ERROR are compensated by including the power supplier 340. The power supplier 340 can detect the pixel power voltage V_PIX provided to the pixels and the pixel power current I_PIX flowing through the pixels, calculate the degree of the degradation of pixels based on the pixel power voltage V_PIX and the pixel power current I_PIX, and generate the power voltage Vp that compensates the degree of the degradation of pixels. Here, the power supplier 340 can accurately compensate the degradation of the display panel by applying the power voltage error V_ERROR and the power current error I_ERROR that are stored in the power supplier 340.

Figure 6:
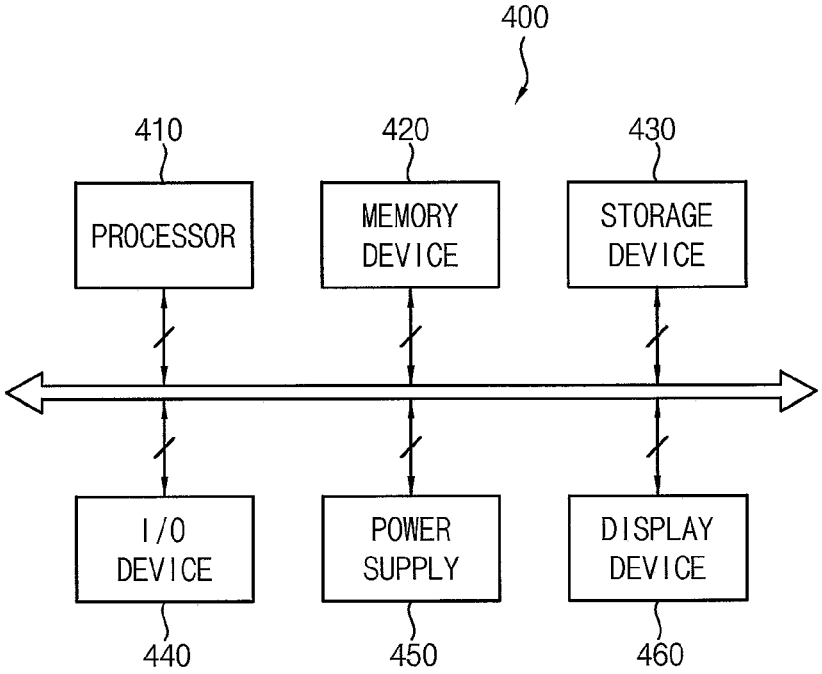
FIG. 6 is a block diagram illustrating an electronic device that includes the display device of FIG. 4.
Figure 7:
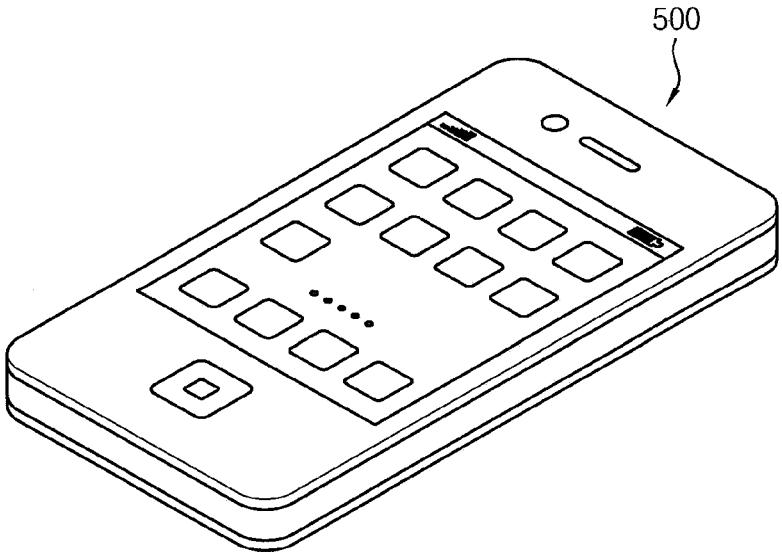
FIG. 7 is a diagram illustrating an example embodiment in which the electronic device of FIG. 6 is implemented as a smartphone.

FIG. 6 is a block diagram illustrating an electronic device that includes the display device of FIG. 4. FIG. 7 is a diagram illustrating an example embodiment in which the electronic device of FIG. 6 is implemented as a smart phone.

Referring to FIGS. 6 and 7, the electronic device 400 include a processor 410, a memory device 420, a storage device 430, an input/output (I/O) device 440, a power supply 450, and a display device 460. Here, the display device 460 can correspond to the display device 300 of FIG. 4. In addition, the electronic device 400 can further include a plurality of ports for communicating a video card, a sound card, a memory card, a universal serial bus (USB) device, other electronic device, etc. Although it is illustrated in FIG. 7 that the electronic device 400 is implemented as a smartphone 500, the kind of the electronic device 400 is not limited thereto.

The processor 410 can perform various computing functions. The processor 410 can be a microprocessor, a central processing unit (CPU), etc. The processor 410 can be coupled to other components via an address bus, a control bus, a data bus, etc. Further, the processor 410 can be coupled to an extended bus such as peripheral component interconnect (PCI) bus. The memory device 420 can store data for operations of the electronic device 400. For example, the memory device 420 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 can be a solid state drive (SSD) device, a hard disk drive (HDD) device, a CD-ROM device, etc.

The I/O device 440 can be an input device such as a keyboard, a keypad, a touchpad, a touchscreen, a mouse, etc., and an output device such as a printer, a speaker, etc. In some embodiments, the display device 460 is included in the I/O device 440. The power supply 450 can provide power for operations of the electronic device 400. The display device 460 can communicate with other components via the buses or other communication links.

The described technology can be applied to a display device and an electronic device having the display device. For example, the described technology can be applied to computer monitors, laptop computers, digital cameras, cell phones, smartphones, smart pads, televisions, personal digital assistants (PDAs), portable multimedia players (PMPs), MP3 players, navigation systems, game consoles, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A power supply device for a display device, comprising:

a direct current to direct current (DC-DC) converter including a power supply having an input voltage and configured to i) generate a power voltage and a power current based at least in part on the input voltage and a feedback voltage and ii) supply the power voltage to an output line;

a detector configured to detect the power voltage and the power current;

a feedback circuit configured to i) generate the feedback voltage based at least in part on the power voltage and the power current and ii) supply the feedback voltage to the DC-DC converter; and a memory storage device comprising a non-volatile memory and configured to store i) a power error voltage signal corresponding to a power error voltage inherent to the power supply device and including the difference between the power voltage and a reference power voltage and ii) a power error current signal inherent to the power supply device and corresponding to a power error current including the difference between the power current and a reference power current.

2. The power supply device of claim 1, wherein the power supply is electrically connected to an external system, and wherein the external system is configured to i) receive the power voltage and the power current from the power supply, ii) calculate the power error voltage and the power error current based at least in part on the power voltage and the power current, and iii) write the power error voltage signal and the power error current signal into the memory.

3. The power supply device of claim 2, wherein the detector includes:

a detection resistor formed in the output line; and an analog-digital converter configured to convert i) the power voltage into a first digital signal and ii) a voltage between opposing ends of the detection resistor into a second digital signal.

4. The power supply device of claim 3, wherein the analog-digital converter is further configured to i) convert the reference power voltage, provided from a load device located outside the power supply device, to a third digital signal, ii) convert the reference power current, provided from the load device, to a fourth digital signal, and iii) transmit the third and fourth digital signals to the external system.

5. The power supply device of claim 4, wherein the external system is further configured to i) calculate the power error voltage corresponding to the difference between the first and third digital signals and ii) write the power error voltage signal into the memory.

6. The power supply device of claim 4, wherein the external system is further configured to i) calculate the power error current corresponding to the difference between the second and fourth digital signals and ii) write the power error current signal into the memory.

7. The power supply device of claim 3, further comprising:

a switch configured to receive the reference power current from a load device located external to the power supply device, wherein the analog-digital converter is further configured to i) convert the reference power current into a fourth digital signal and ii) transmit the fourth digital signal to the external system.

8. The power supply device of claim 7, wherein the switch is further configured to selectively supply the reference power current corresponding to a normal mode or a low current mode to the analog-digital converter.

9. The power supply device of claim 1, wherein the power supply is electrically connected to an external system, and wherein the external system is further configured to i) generate a feedback control signal based at least in part on a first digital signal corresponding to the power voltage and a second digital signal corresponding to the power current, and ii) transmit the feedback control signal to the feedback unit.

10. The power supply device of claim 9, wherein the feedback circuit includes:

a digital-analog converter configured to convert the feedback control signal to a feedback analog signal; and a feedback voltage generator configured to generate the feedback voltage based at least in part on the feedback analog signal, wherein the DC-DC converter is further configured to control the power voltage based at least in part on the feedback voltage.

11. The power supply device of claim 10, wherein the feedback voltage generator includes a plurality of resistors configured to voltage-divide the feedback analog signal into a plurality of voltages, and wherein the feedback voltage generator is further configured to select one of the divided voltages and output the selected divided voltage as the feedback voltage.

12. A display device comprising:

a display panel including a plurality of pixels;

a data driver configured to supply a data signal to the pixels;

a scan driver configured to supply a scan signal to the pixels;

a power supplier configured to i) generate a power voltage based at least in part on an input voltage and a feedback voltage and provide the power voltage to the pixels through an output line, wherein the output line is configured to transfer a power current; and a timing controller configured to control the data driver, the scan driver, and the power supplier, wherein the power supplier is further configured to store, in a storage device comprising a non-volatile memory, i) a power error voltage signal inherent to the power supplier and corresponding to a power error voltage including the difference between the power voltage and a reference power voltage, and ii) a power error current signal inherent to the power supplier corresponding to a power error current including the difference between the power current and a reference power current.

13. The display device of claim 12, wherein the display panel is configured to transmit a pixel power voltage and a pixel power current to the pixels, and wherein the power supplier includes:

a direct current to direct current (DC-DC) converter configured to i) generate the power voltage based at least in part on the input voltage and the feedback voltage and ii) transmit the power voltage to the output line;

a detector configured to detect the pixel power voltage and the pixel power current through a detecting line;

a feedback circuit configured to i) generate the feedback voltage based at least in part on the pixel power voltage and the pixel power current and ii) transmit the feedback voltage to the DC-DC converter; and an memory configured to store the power error voltage signal and the power error current signal.

14. The display device of claim 13, wherein the timing controller is further configured to receive the power error voltage signal and the power error current signal when the display panel is turned on.

15. The display device of claim 13, wherein the detector includes:

a detection resistor formed in the detecting line; and an analog-digital converter configured to convert the pixel power voltage to a first digital signal and convert a voltage between opposing ends of the detection resistor to a second digital signal.

16. The display device of claim 15, wherein the timing controller is further configured to generate a feedback control signal based at least in part on the first and second digital signals, the power error voltage signal, and the power error current signal, and wherein the feedback control is configured to control the feedback circuit.

17. The display device of claim 16, wherein the feedback circuit includes:

a digital-analog converter configured to convert the feedback control signal to a feedback analog signal; and a feedback voltage generator configured to generate the feedback voltage based at least in part on the feedback analog signal, wherein the DC-DC converter is further configured to control the power voltage based at least in part on the feedback voltage.

18. The display device of claim 17, wherein the feedback voltage generator includes a plurality of resistors configured to voltage-divide the feedback analog signal into a plurality of voltages, and wherein the feedback voltage generator is further configured to select one of the divided voltages and output the selected divided voltage as the feedback voltage.

19. The display device of claim 12, wherein the power supplier is electrically connected to the timing controller.

20. The display device of claim 12, wherein the timing controller includes the power supplier.

* * * * *